US009889965B2

(12) United States Patent
Morgan et al.

(10) Patent No.: US 9,889,965 B2
(45) Date of Patent: Feb. 13, 2018

(54) LEAK-PROOF, INTERLOCKING, STACKABLE, FOOD, SPICE, AND LIQUID TRAVEL

(71) Applicants: William Earl Morgan, Golden, CO (US); Linda Lee Morgan, Golden, CO (US)

(72) Inventors: William Earl Morgan, Golden, CO (US); Linda Lee Morgan, Golden, CO (US)

( * ) Notice: Subject to any disclaimer, the term of this patent is extended or adjusted under 35 U.S.C. 154(b) by 0 days.

(21) Appl. No.: 15/257,712

(22) Filed: Sep. 6, 2016

(65) Prior Publication Data

US 2016/0368662 A1 Dec. 22, 2016

Related U.S. Application Data

(63) Continuation-in-part of application No. 14/828,871, filed on Aug. 18, 2015, now abandoned.

(60) Provisional application No. 62/039,288, filed on Aug. 19, 2014.

(51) Int. Cl.

| | |
|---|---|
| ***B65D 21/032*** | (2006.01) |
| ***B65D 21/02*** | (2006.01) |
| ***A45C 11/20*** | (2006.01) |
| ***A45F 3/16*** | (2006.01) |
| ***B65D 43/02*** | (2006.01) |
| ***B65D 59/02*** | (2006.01) |

(52) U.S. Cl.

CPC ..... *B65D 21/0228* (2013.01); *A45C 11/20* (2013.01); *A45F 3/16* (2013.01); *B65D 43/0212* (2013.01); *B65D 43/0231* (2013.01); *B65D 59/02* (2013.01); *B65D 2251/0018* (2013.01); *B65D 2251/0081* (2013.01); *B65D 2543/00092* (2013.01); *B65D 2543/00509* (2013.01); *B65D 2543/00546* (2013.01); *B65D 2543/00851* (2013.01)

(58) Field of Classification Search

CPC . B65D 21/0228; B65D 59/02; B65D 43/0231
USPC ..... 220/578
See application file for complete search history.

(56) References Cited

U.S. PATENT DOCUMENTS

| | | | | |
|---|---|---|---|---|
| 3,067,896 A * | 12/1962 | Berg | ..... | A47J 41/028 215/10 |
| 4,209,105 A * | 6/1980 | Dominique | ..... | B65D 53/02 220/222 |
| 2008/0308555 A1 * | 12/2008 | Stolzman | ..... | B65D 1/16 220/288 |

(Continued)

*Primary Examiner* — Stephen Castellano

(57) ABSTRACT

A leak-proof, interlocking, stackable travel container assembly has a sealing plug and a plurality of travel containers. The sealing plug is designed to create an airtight seal when positioned within an opening. In order to do so, the sealing plug has a first sealing ring, a second sealing ring and a lip. Each of the plurality of travel containers has a neck portion, an opening, a body portion and a base portion. The opening perpendicularly traverses into the neck portion allowing an user to place and remove items within the travel container. When required, the sealing plug is placed within the opening. Next, a protective cap is used to surround the sealing plug. If multiple travel containers are to be used, a base interlocking mechanism and a neck interlocking mechanism are used for interlocking each of the plurality of travel containers.

9 Claims, 15 Drawing Sheets

(56) References Cited

U.S. PATENT DOCUMENTS

2014/0360908 A1* 12/2014 Sorensen ..... B65D 21/0228
206/501

* cited by examiner

LEAK-PROOF, INTERLOCKING, STACKABLE, FOOD, SPICE, AND LIQUID TRAVEL

The current application is a continuation-in-part (CIP) application of a U.S. non-provisional application Ser. No. 14/828,871 filed on Aug. 18, 2015 now abandoned. The U.S. non-provisional application Ser. No. 14/828,871 claims a priority to a U.S. provisional application Ser. No. 62/039,288 filed on Aug. 19, 2014.

FIELD OF THE INVENTION

The present invention relates generally to travel containers. More specifically, the present invention introduces a set of leak-proof, interlocking, stackable travel containers for travel purposes. The set of travel containers, which can be used to carry foods, spices, and liquids, is available in multiple sizes and provides the user with different configurations.

BACKGROUND OF THE INVENTION

A very popular and rapidly growing method of travel for business and vacation is staying at timeshares, hotels, motels, suites and resorts that offer kitchen or kitchenette facilities for preparing meals. The problem is that most people spend a great deal of money buying all of their cooking foods, spices, oils, herbs, fruits, vegetables, alcohol and mixers when they get to their destination. Many travelers will attempt to use plastic storage baggies for non-liquid items and an array of different leak-resistant containers for some of their liquid items, but most have experienced leakage of some sort in their luggage due to breakage or exploding due to altitude pressure changes. Because their containers are all different sizes and shapes, they are not convenient to pack and may be difficult to find, especially if multiple stays are required in route to their final destination. When travelers end up buying their foods, spices and liquids in route, or at their final destination, they end up having to buy much more than they can use during their stay, and consequently end up leaving a majority of their purchases on the counter as waste to be thrown away upon their departure. Over a one week stay, this can amount to several hundred dollars of wasted purchases. Therefore, the need for a solution is clearly evident.

The present invention is a set of leak-proof, interlocking, stackable travel containers which can be used for carrying foods, spices, liquids, powders, cosmetics, medications, special dietary foods and any other comparable items. The present invention enables travelers who prefer to prepare their own meals, while traveling for business or pleasure, via air, automobile while hiking, biking, camping, or staying at a facility with kitchen availability to take spices, herbs, oils, foods, liquors & condiments in the exact amounts they need for the duration of their stay away from home. The invention is designed of 8 equal widths but different height containers ranging from 0.5 oz. to 19 oz., which allows for 42 different stacking options that will fit in a light weight, leak resistant travel case in columns of 3 stacks of variable sized containers based on user choice. The invention provides a leak-proof, light weight, durable, water clear, well organized group of containers that use up very little packing space, reduce user costs and reduce user waste of products that would otherwise have to be purchased at their destination, and most likely left behind as wasted product upon their departure. These containers provide travelers with a leak-proof method of organization, flexibility and convenience that no other product on the market today can provide. This invention was designed by a traveler to provide a solution to problems met by an increasing number of travelers around the world.

The present invention has a target market of outdoor, sports and travel enthusiasts or any other market requiring similar storage needs. The present invention may also be offered to a target audience of timeshare owners/renters, travelers staying at suites with kitchens, auto travelers, R.V. travelers, hunters, fisherman, motor cyclists, tailgaters for sporting events and concerts, boating enthusiasts, camping enthusiasts, hiking enthusiasts, children having sleepovers with friends, persons traveling with special dietary food needs, persons carrying medications among others. The present invention is intended to target any individual or groups of users, with a primary focus on adults and adolescents. In the preferred embodiment, the present invention may be sold all together with a variety of container units in one offering as a starter kit with travel case, as well as sold separately based on the individual user's preferences.

Currently, existing inventions only serve small, specialized markets that do not include the much broader market reached by this proposed product. The present invention is far more flexible in its ability to carry diversified liquids, foods, and spices as well as products requiring refrigeration. It can take on several shapes for packing, quantity and carrying needs. It is dishwasher safe, freezer safe, FDA approved and BPA free. It offers a "Starter Kit" to allow customers a specific assortment of sizes for their first and ongoing purchases. In addition, it offers the purchase of additional cylinder configurations for customizing the starter kit and/or building an additional kit based on customer needs.

DETAIL DESCRIPTIONS OF THE INVENTION

All illustrations of the drawings are for the purpose of describing selected versions of the present invention and are not intended to limit the scope of the present invention.

The present invention introduces a leak-proof, interlocking, stackable travel container assembly that can be used for storing and carrying herbs, liquids, foods, spices, condiments and other comparable items. By utilizing the present invention, the inconvenience caused from not having a required item or the possibility of having to purchase and then discard a certain item due to having an excess amount is eliminated. The leak-proof nature guarantees that the items stored within the present invention can be safely carried regardless of the nature of the items and the orientation of the containers holding the items.

Figure 1:
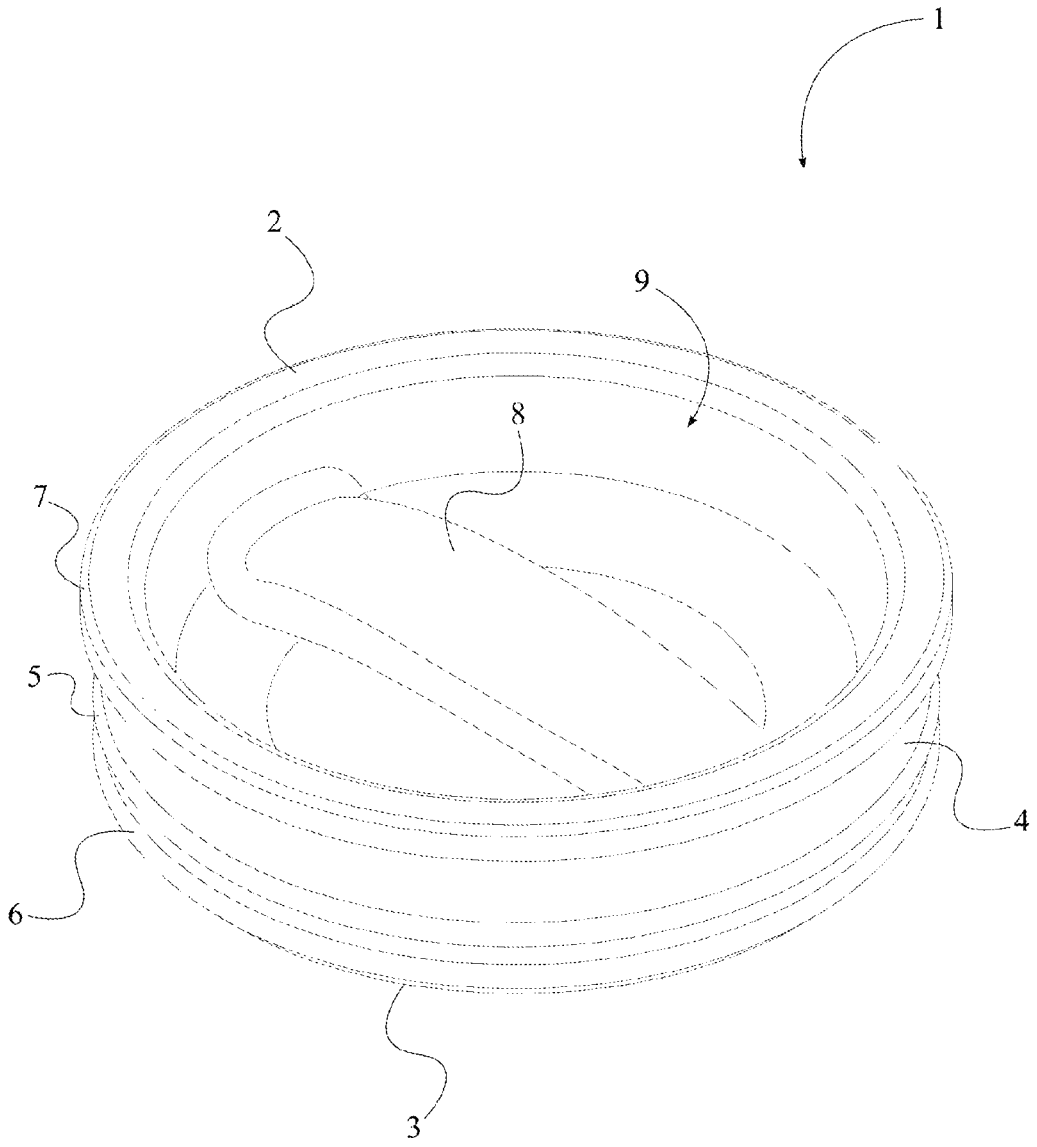
FIG. 1 is a perspective view of the sealing plug.
Figure 2:
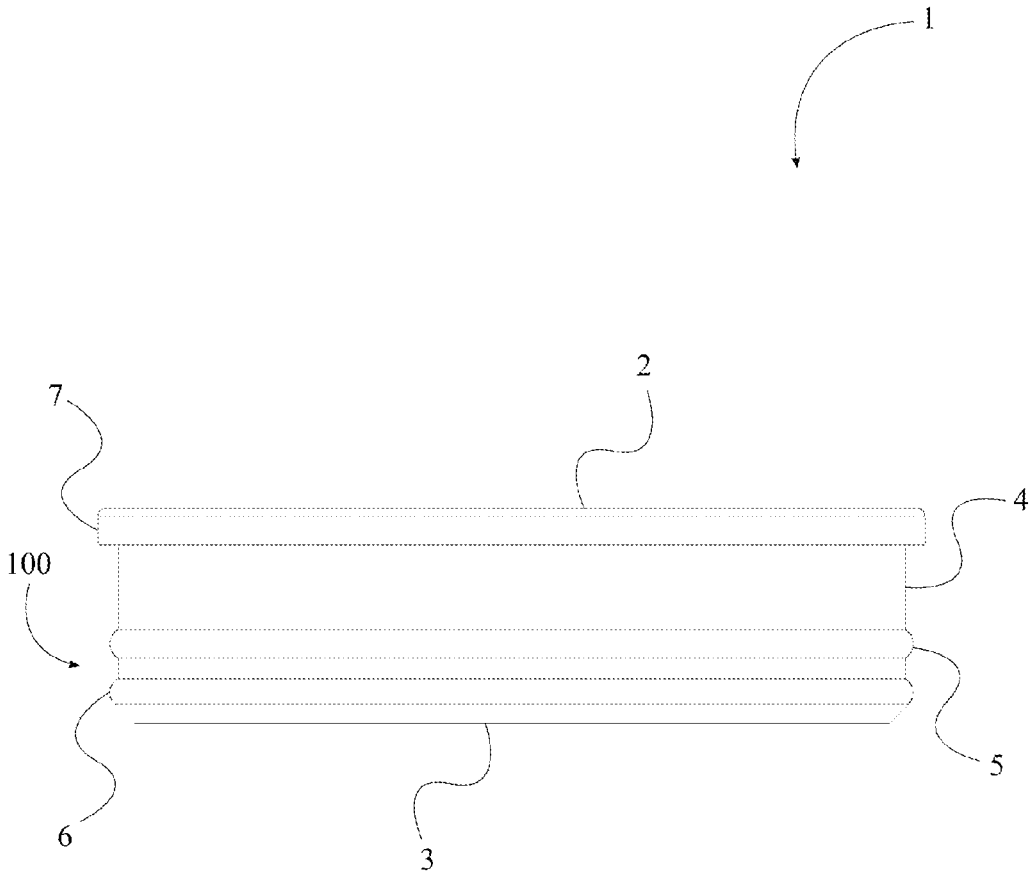
FIG. 2 is a side view of the sealing plug.
Figure 3:
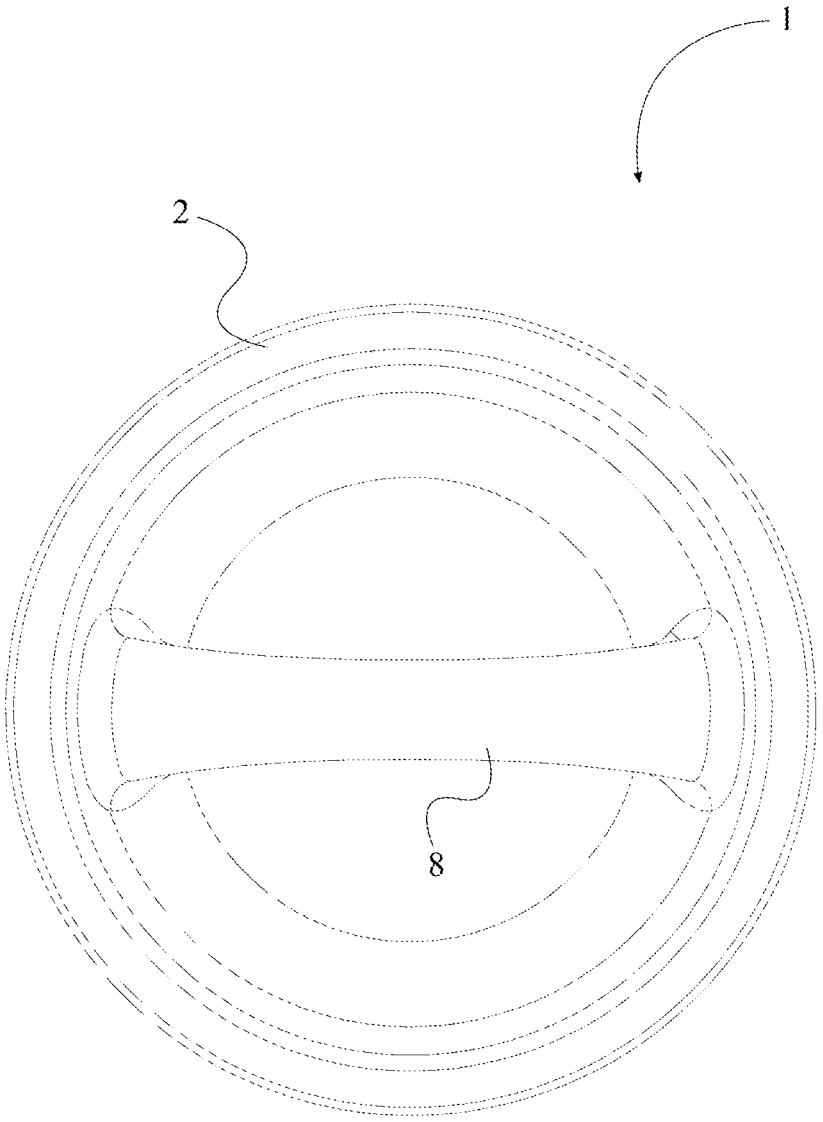
FIG. 3 is a top view of the sealing plug.

The present invention utilizes a sealing plug 1 to make the present invention leak-proof. The sealing plug 1, which is illustrated in FIGS. 1-3, is designed so that an opening in which the sealing plug 1 is used in is concealed at multiple locations. The multiple seals eliminate the possibility for material or air to travel through the sealing plug 1. Resultantly, the quality and quantity of an item stored using the present invention is preserved. The sealing plug 1 in the preferred embodiment of the present invention comprises a top end 2, a bottom surface 3, a lateral surface 4, at least one sealing ring 100, a cavity 9, a handgrip 8, and a lip 7. The lateral surface 4 extends from the top end 2 to the bottom surface 3 and determines the height of the sealing plug 1. In the preferred embodiment of the present invention, the lateral surface 4 is shaped to be circular so that the overall shape of the sealing plug 1 is circular. However, the shape and size of the sealing plug 1 can vary in different embodiments of the present invention. The cavity 9 traverses from the top end 2 towards the bottom surface 3 allowing the handgrip 8 to be centrally positioned within the cavity 9. The handgrip 8 is used to conveniently position the sealing plug 1 appropriately and remove the sealing plug 1 when necessary. In other words, the handgrip 8 is beneficial to position the sealing plug 1 so that an airtight seal is formed. When the sealing plug 1 is positioned as required, the airtight seal is created with the lip 7 and the at least one sealing ring 100. For the sealing plug 1 to be airtight from the top end 2 to the bottom surface 3, the lip 7 is positioned along the lateral surface 4 and adjacent to the top end 2. On the other hand, the at least one sealing ring 100 is positioned along the lateral surface 4 and adjacent to the bottom surface 3. In the preferred embodiment of the present invention, the sealing plug 1 comprises a first sealing ring 6 and a second sealing ring 5 as the at least one sealing ring 100. When considering the positioning on the sealing plug 1, the first sealing ring 6 is positioned adjacent to the bottom surface 3. The second sealing ring 5 is positioned adjacent to the first sealing ring 6 and opposite to the bottom surface 3. Even though only two sealing rings are used in the preferred embodiment of the present invention, the number of sealing rings used as the at least one sealing ring 100 can vary in different embodiments of the present invention. The first sealing ring 6 and the second sealing ring 5 are positioned on the lateral surface 4 and opposite to the cavity 9. Therefore, when the sealing plug 1 is positioned as necessary, the lip 7 along with both the first sealing ring 6 and the second sealing ring 5 press firmly against an external wall.

Figure 4:
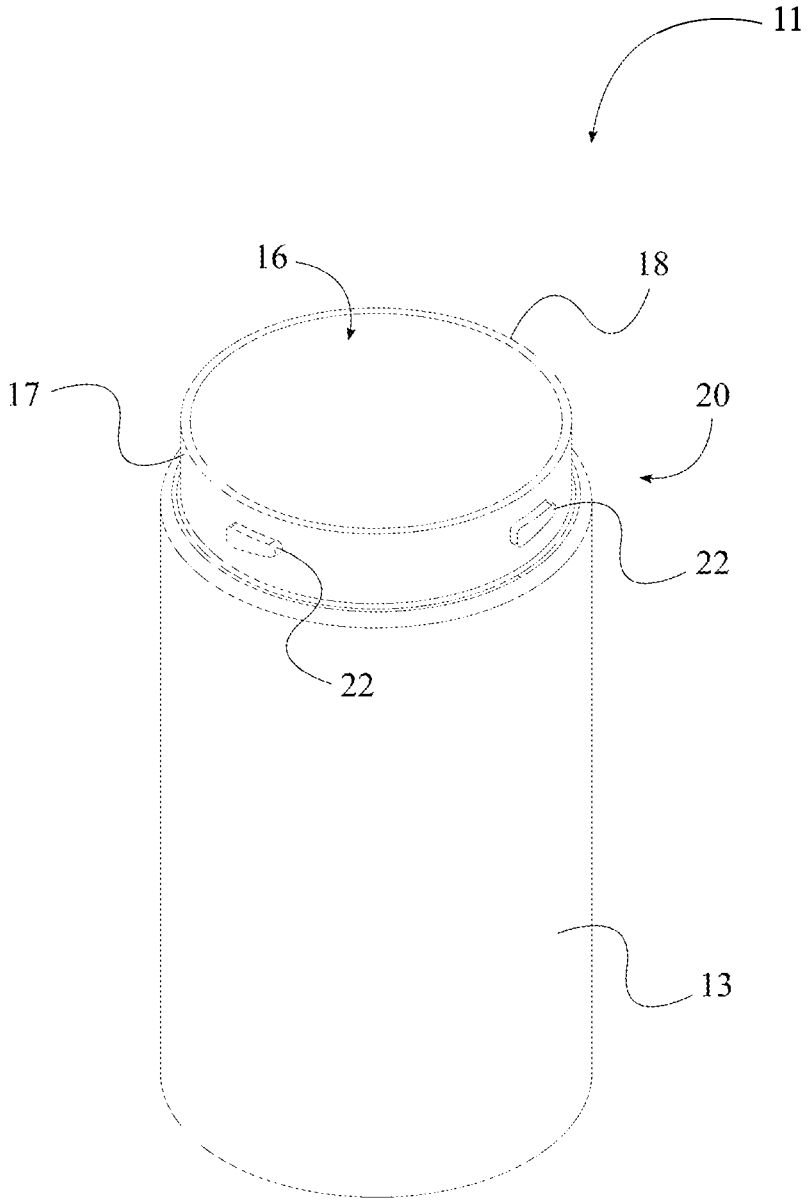
FIG. 4 is a perspective view of one of the plurality of travel containers.
Figure 5:
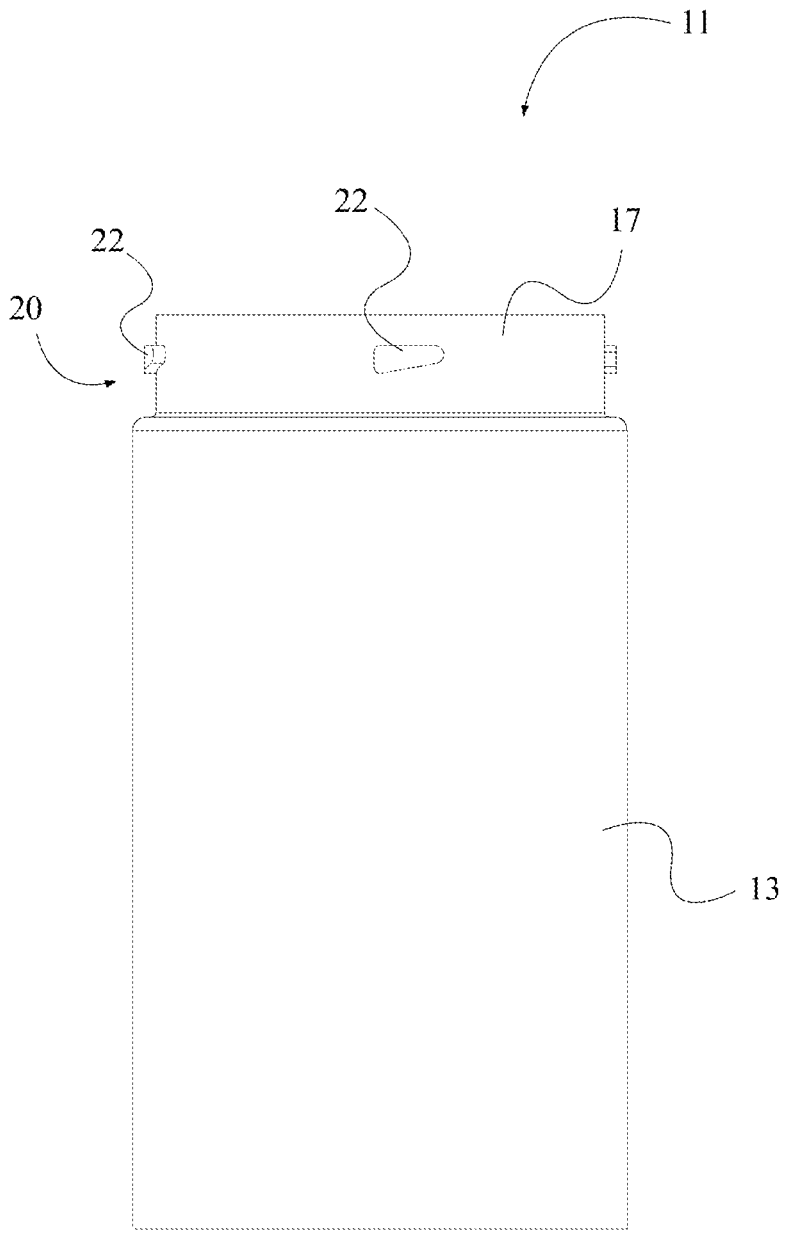
FIG. 5 is a side view of one of the plurality of travel containers.
Figure 6:
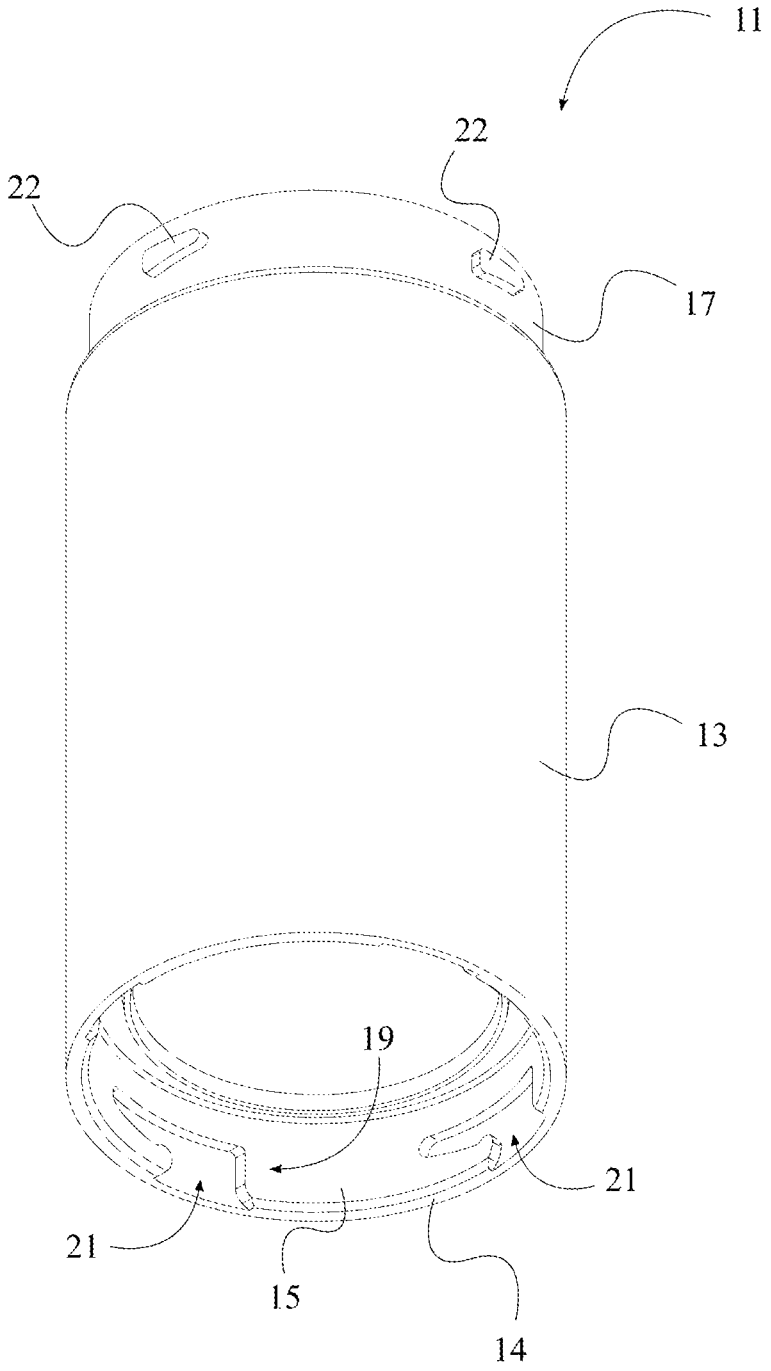
FIG. 6 is a bottom perspective view of one of the plurality of travel containers.
Figure 10:
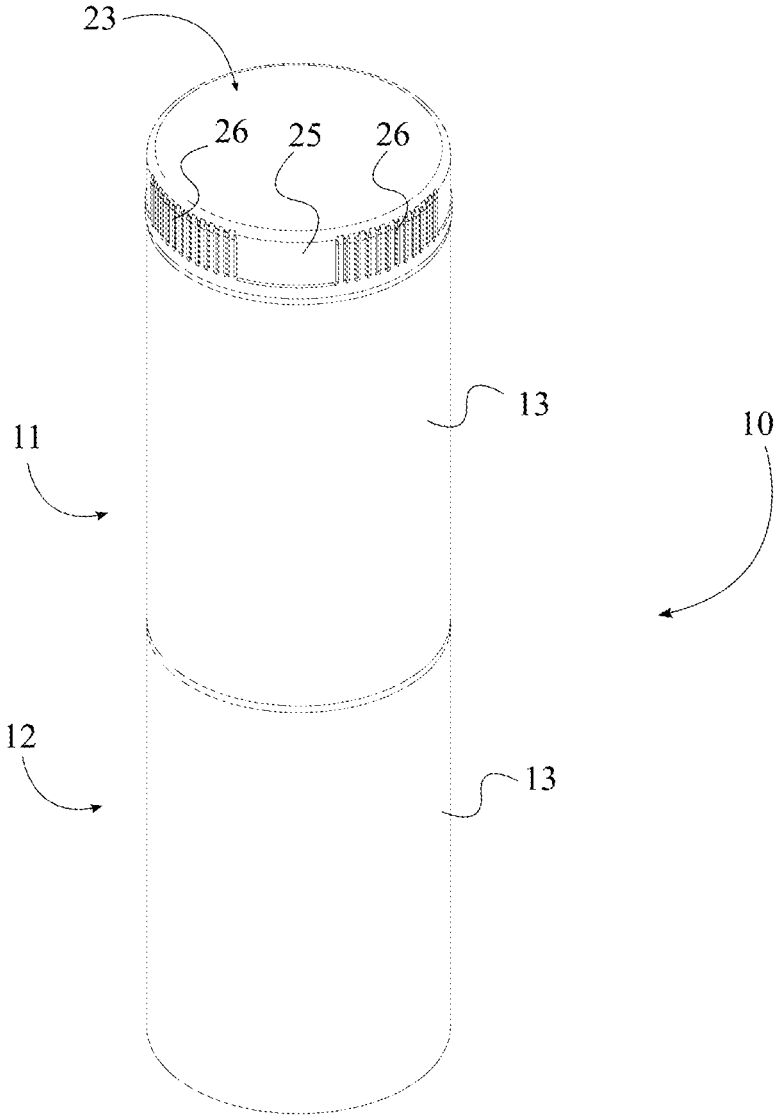
FIG. 10 is a perspective view of an assembly of the protective cap, the sealing plug, and the plurality of travel containers.
Figure 11:
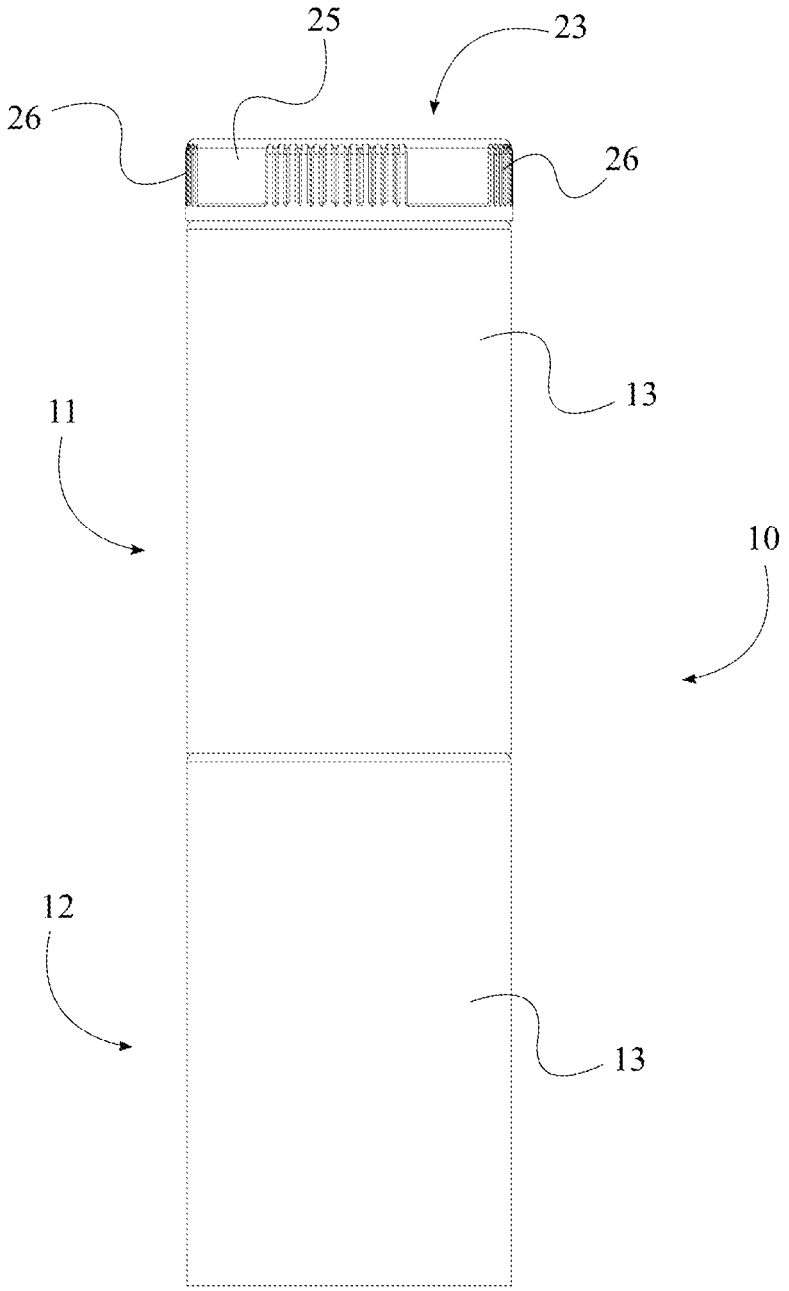
FIG. 11 is a side view of the assembly of the protective cap, the sealing plug, and the plurality of travel containers.
Figure 12:
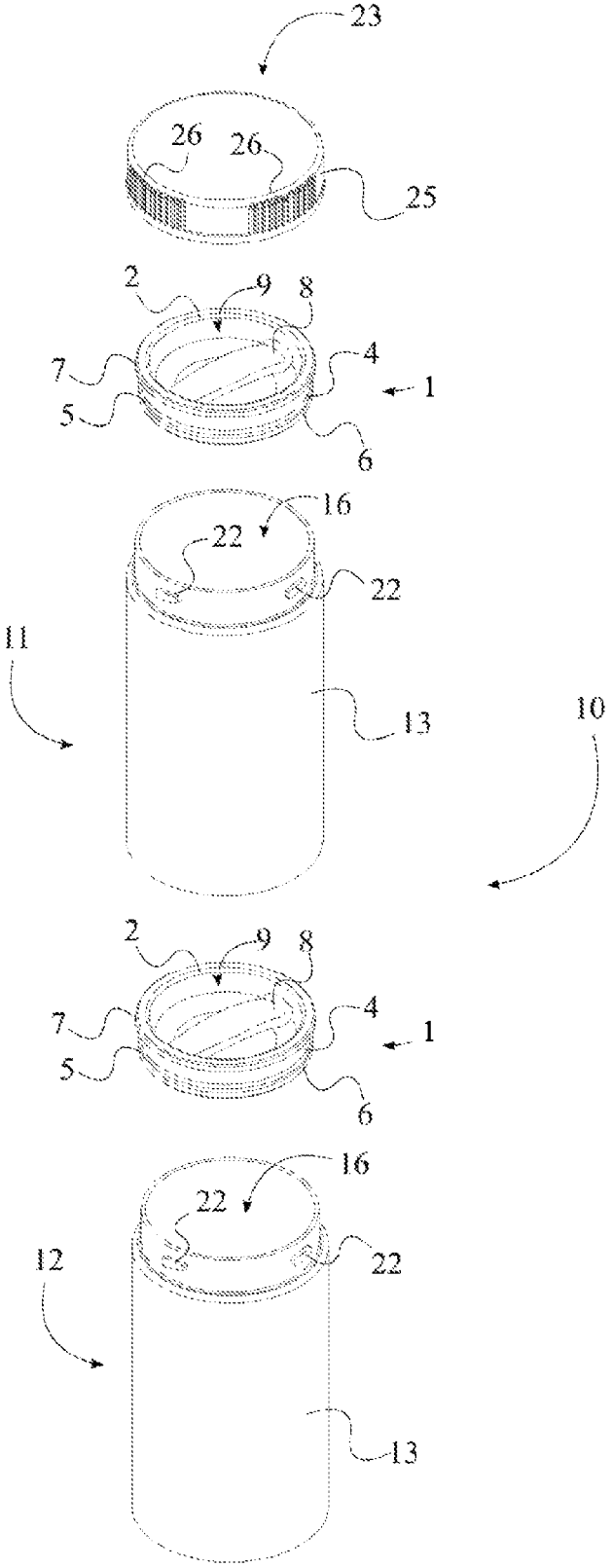
FIG. 12 is an exploded view of the assembly of the protective cap, a plurality of sealing plugs, and the plurality of travel containers.
Figure 13:
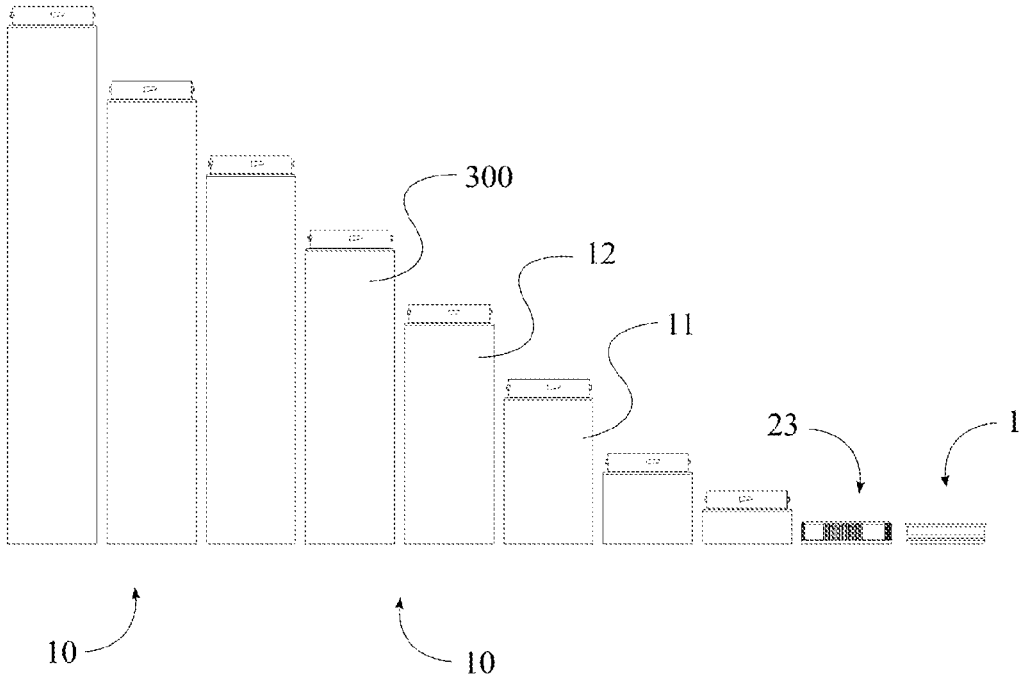
FIG. 13 is an illustration of the different sizes available for the plurality of travel containers.
Figure 14:
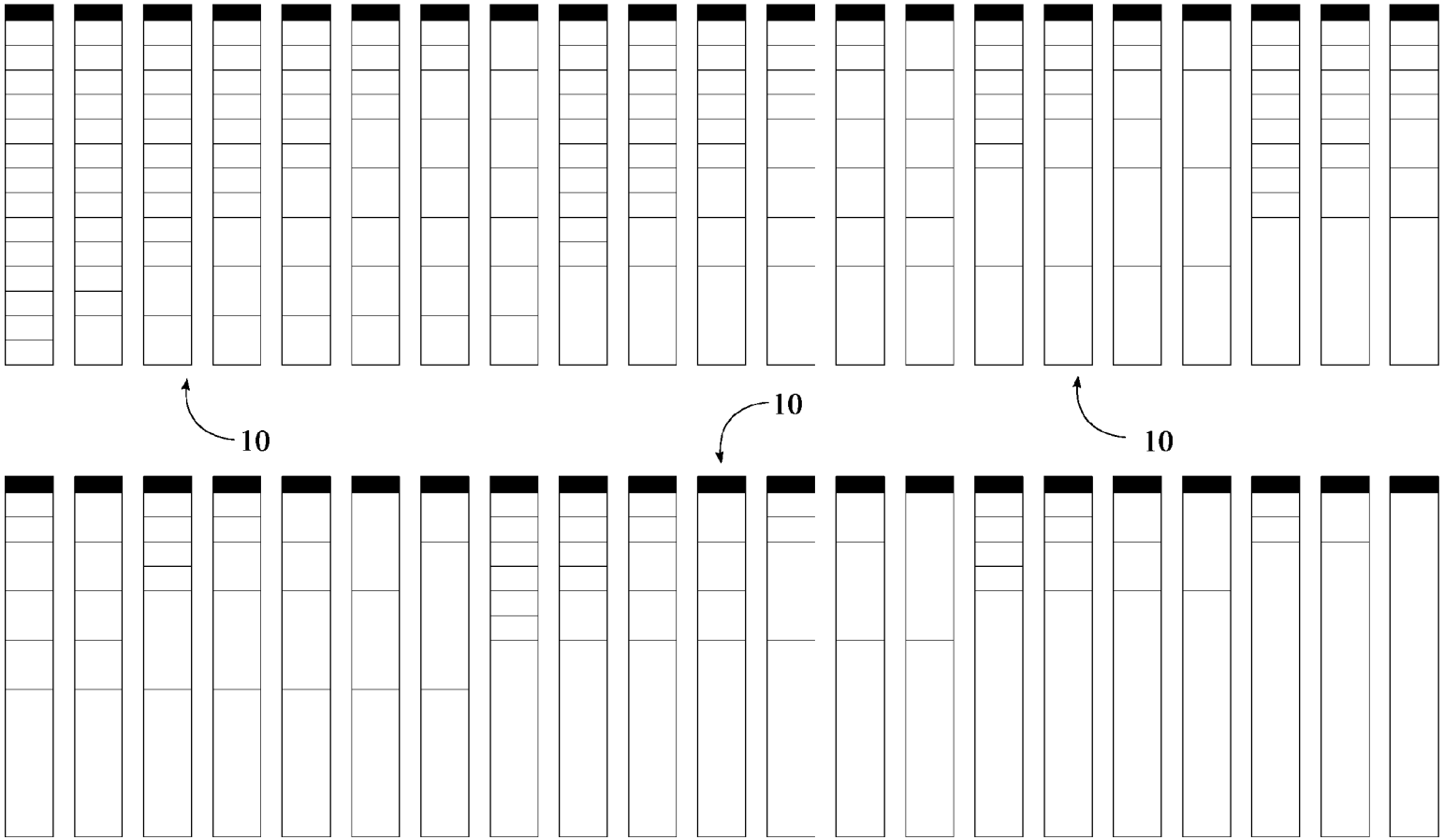
FIG. 14 is an illustration of the plurality of travel containers stacked in different configurations.

The present invention further comprises a plurality of travel containers 10 which is used along with the sealing plug 1. Each of the plurality of travel containers 10 can be interlocked to each other and is available in different sizes so that a wide variety of items of different quantities can be carried according to user preference. As seen in FIG. 13 and FIG. 14, in the preferred embodiment of the present invention, the plurality of travel containers 10 is available in eight different sizes and has the ability to be arranged in forty-two different configurations. As illustrated in FIGS. 10-12, the plurality of travel containers 10 comprises a primary container 11 and a secondary container 12. In general, the topmost container of the plurality of travel containers 10 in a given configuration is referred to as the primary container 11. On the other hand, the subsequent container of the plurality of travel containers 10 is referred to as the secondary container 12. As illustrated in FIGS. 4-6, each of the plurality of travel containers 10 comprises an opening 16, a neck portion 17, a body portion 13, a base portion 14, a base interlocking mechanism 19, and a neck interlocking mechanism 20. The body portion 13 extends from the neck portion 17 to the base portion 14 and determines the height and shape of each of the plurality of travel containers 10. In order to do so, the base portion 14 is adjacently connected to the body portion 13. Moreover, the neck portion 17 is adjacently connected to the body portion 13 but opposite to the base portion 14. In the preferred embodiment of the present invention, each of the plurality of travel containers 10 is cylindrical in shape. The opening 16 is used to place an item within the each of the plurality of travel containers 10. The opening 16 is also used to remove an item from each of the plurality of travel containers 10. In order to provide user convenience when placing and removing items from each of the plurality of travel containers 10, the opening 16 perpendicularly traverses into the neck portion 17 opposite to the body portion 13. When a selected item is placed within one of the plurality of travel containers 10, the opening 16 is then sealed with the sealing plug 1. As an example, if an item is placed within the primary container 11, the sealing plug 1 is removably positioned within the opening 16 of the primary container 11. When the sealing plug 1 is removably positioned, the lip 7 rests on a rim 18 which delineates the opening 16 of each of the plurality of travel containers 10. More specifically, the rim 18 is connected to the neck portion 17 opposite to the body portion 13. When placing a preferred item is complete, the base interlocking mechanism 19 and the neck interlocking mechanism 20 is used if the primary container 11 is to be interlocked with the secondary container 12. More specifically, the base interlocking mechanism 19 of the primary container 11 is removably attached to the neck interlocking mechanism 20 of the secondary container 12. In order to do so, the base interlocking mechanism 19 is positioned along the base portion 14 for each of the plurality of travel containers 10. Similarly, the neck interlocking mechanism 20 is positioned along the neck portion 17 for each of the plurality of travel containers 10.

Figure 7:
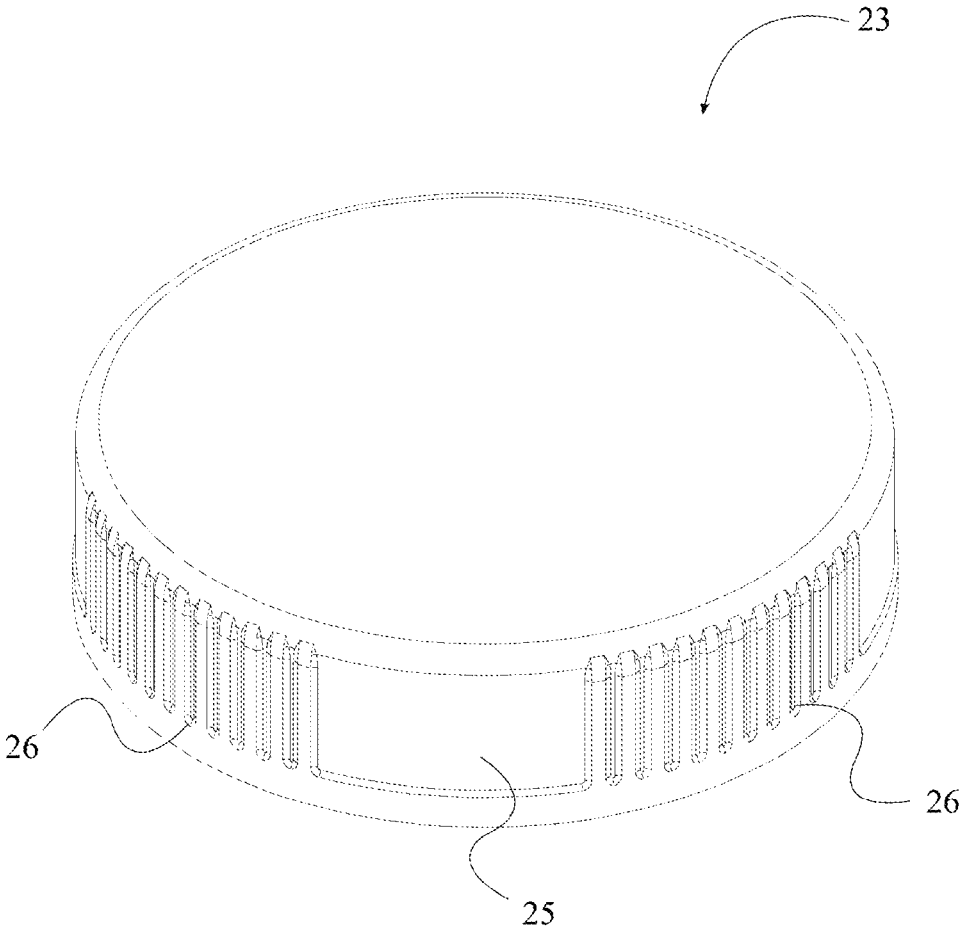
FIG. 7 is a perspective view of the protective cap.
Figure 8:
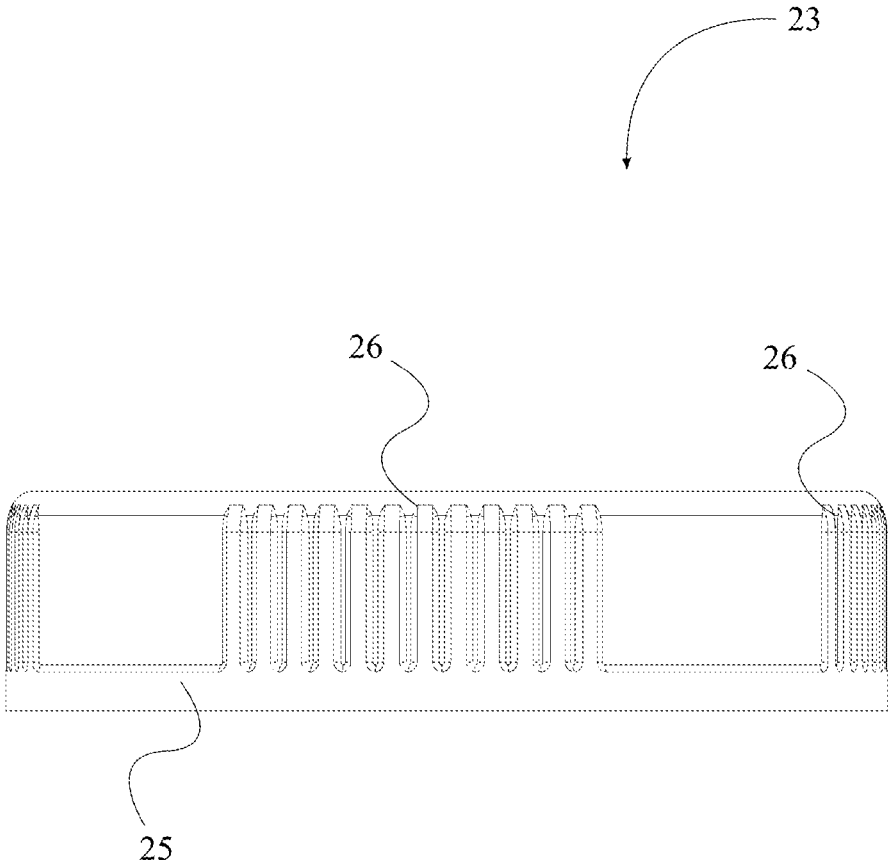
FIG. 8 is a side view of the protective cap.
Figure 9:
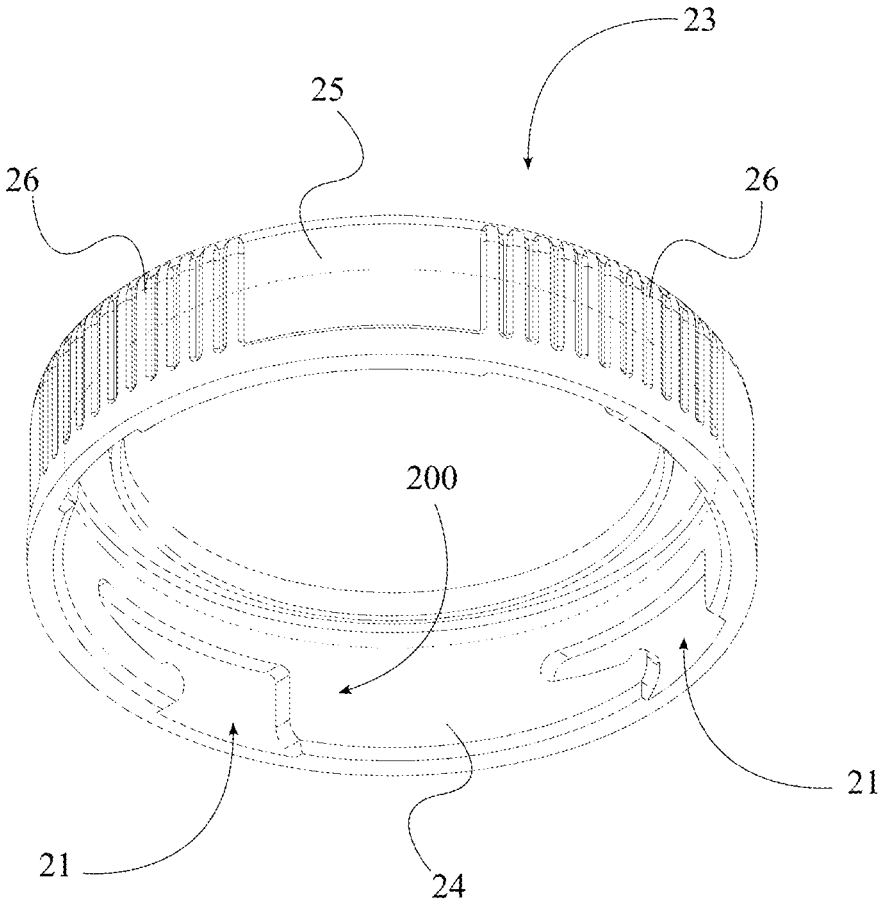
FIG. 9 is a bottom perspective view of the protective cap.

As illustrated in FIGS. 7-9, the present invention further comprises a protective cap 23. The protective cap 23 is intended to be positioned over the topmost travel container of a configuration made from the plurality of travel containers 10. As an example, if the protective cap 23 and the sealing plug 1 are intended to be used with the primary container 11, the protective cap 23 is positioned so that the sealing plug 1 is surrounded by the protective cap 23. Since the handgrip 8 is positioned within the cavity 9 and does not extend outwards beyond the top end 2, the sealing plug 1 does not interfere with the process of positioning the protective cap 23. For the protective cap 23 to remain stationary when attached, the protective cap 23 comprises a cap interlocking mechanism 200. The cap interlocking mechanism 200 is removably attached to the neck interlocking mechanism 20 of the primary container 11 so that the protective cap 23 can be separated from the primary container 11 according to user preference. In the preferred embodiment of the present invention, a plurality of female receptors 21 of the cap interlocking mechanism 200 is radially distributed about an inner lateral surface 24 of the protective cap 23. When attached, a plurality of radial pins 22 of the primary container 11 is removably positioned into the plurality of female receptors 21 of the protective cap 23. The lack of a firm grip can be a concern when tightening or loosening the protective cap 23 from the plurality of travel containers 10. In order to address the issue, the present invention comprises a plurality of gripping portions 26 which is distributed along an outer lateral surface 25 of the protective cap 23.

In the preferred embodiment of the present invention, a bayonet mount mechanism is used as the neck interlocking mechanism 20 and the base interlocking mechanism 19. However, the neck interlocking mechanism 20 and the base interlocking mechanism 19 can vary in different embodiments of the present invention. As seen in FIG. 5, FIG. 6, and FIG. 12 the neck interlocking mechanism 20 comprises a plurality of radial pins 22 which is radially distributed about the neck portion 17 of each of the plurality of travel containers 10. Moreover, the plurality of radial pins 22 is positioned in between the opening 16 and the body portion 13 of each of the plurality of travel containers 10. As seen in FIG. 6 and FIG. 9, the base interlocking mechanism 19 comprises a plurality of female receptors 21 to correspond to the plurality of radial pins 22. In order to interlock each of the plurality of travel containers 10, the base portion 14 of the primary container 11 is attached to the neck portion 17 of the secondary container 12. Therefore, the plurality of female receptors 21 is radially distributed about the base portion 14. When the need to interlock the primary container 11 to the secondary container 12 occurs, the plurality of radial pins 22 is removably positioned into the plurality of female receptors 21. As discussed earlier, the plurality of travel containers 10 in the preferred embodiment of the present invention is available in eight different sizes. Therefore, when a third container 300 of the plurality of travel containers 10 is used, the base interlocking mechanism 19 of the secondary container 12 is removably attached to the neck interlocking mechanism 20 of the third container 300. In other words, the plurality of radial pins 22 of the third container 300 is removably positioned into the plurality of female receptors 21 of the secondary container 12. Even though only three containers from the plurality of travel containers 10 are described, the user can utilize any number of containers from the plurality of travel containers 10.

Figure 15:
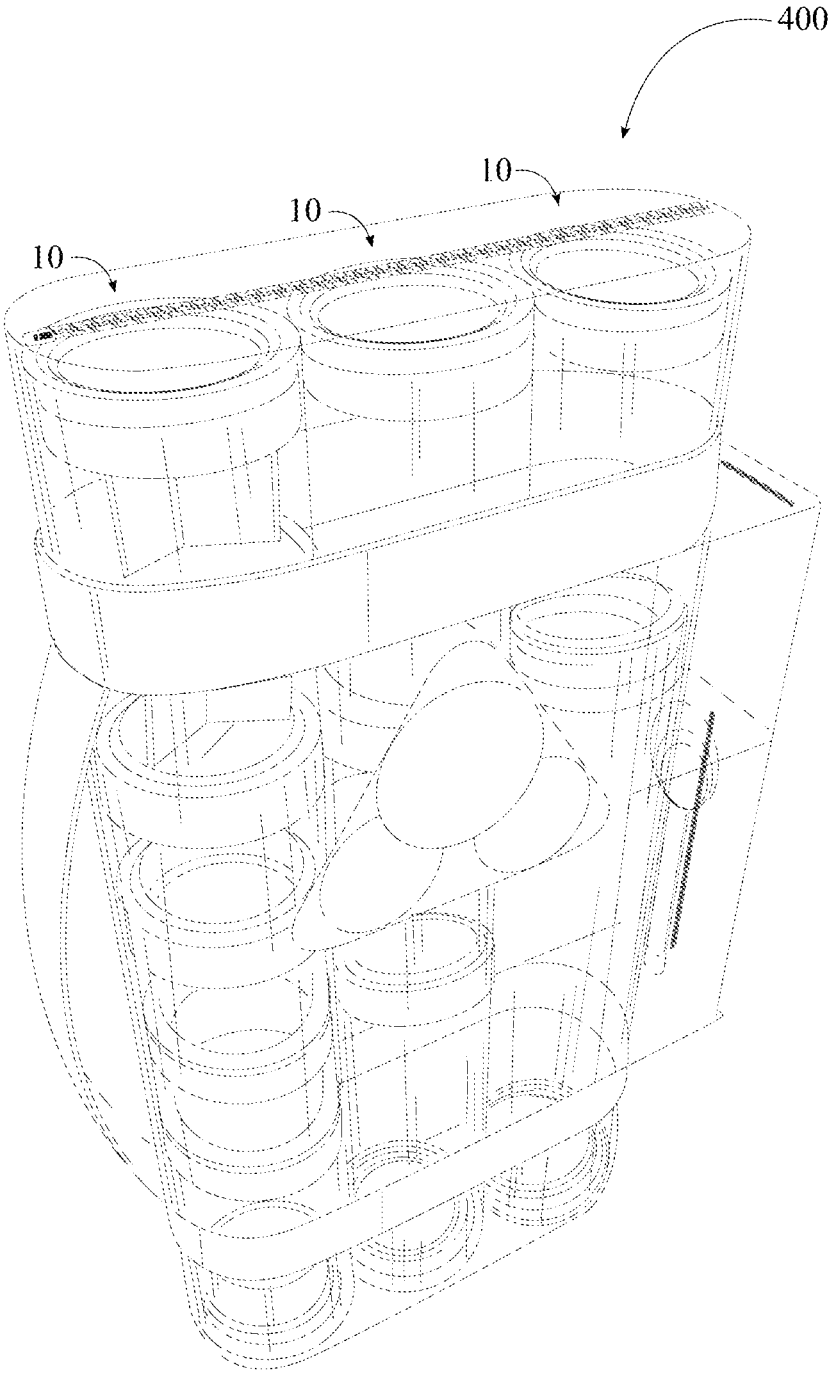
FIG. 15 is an illustration of the plurality of travel containers being stacked in a carrying case.

When utilizing the present invention, the following process flow is generally followed. Initially, the user places a preferred item within one of the plurality of travel containers 10. As an example, we shall consider placing an item within the primary container 11. In doing so, the user utilizes the opening 16 of the primary container 11 to place items within the body portion 13 of the primary container 11. When placing the preferred item is complete, the user then positions the sealing plug 1 within the opening 16. The handgrip 8 is used to hold the sealing plug 1 and tighten the sealing plug 1 within the opening 16 of the primary container 11. When positioned within the opening 16, the lip 7 rests on the rim 18. Moreover, the first sealing ring 6 and the second sealing ring 5 press against an inner wall of the neck portion 17. Next, the user attaches the protective cap 23 so that the sealing plug 1 is surrounded by the protective cap 23. In doing so, the cap interlocking mechanism 200 and the neck interlocking mechanism 20 of the primary container 11 are used. Moreover, the plurality of gripping portions 26 is used to tighten the protective cap 23 around the sealing plug 1. If the secondary container 12 is also being used, the primary container 11 is interlocked with the secondary container 12. More specifically, the base interlocking mechanism 19 of the primary container 11 is interlocked with the neck interlocking mechanism 20 of the secondary container 12. When each of the plurality of travel containers 10 are interlocked to each other the user can conveniently transport the plurality of travel containers with a carrying case 400. As shown in FIG. 15, the carrying case 400 will be sufficiently sized to receive the assembly of the plurality of travel containers 10.

Although the invention has been explained in relation to its preferred embodiment, it is to be understood that many other possible modifications and variations can be made without departing from the spirit and scope of the invention as hereinafter claimed.

What is claimed is:

1. A leak proof, interlocking, stackable travel container assembly comprising:

a plurality of travel containers;

each of the plurality of travel containers comprising a body portion, a base portion adjacently connected to the body portion, a base interlocking mechanism positioned along the base portion, a neck portion adjacently connected to the body portion opposite the base portion, an opening perpendicularly traversing into the neck portion opposite to the body portion and a neck interlocking mechanism positioned along the neck portion and corresponding to the base interlocking mechanism;

a sealing plug;

the sealing plug comprising a top end, a bottom surface, a lateral surface, a first sealing ring, a second sealing ring, a cavity, a handgrip and a lip;

the cavity traversing from the top end towards the bottom surface;

the first sealing ring and the second sealing ring being positioned adjacent to the bottom surface;

the handgrip being centrally positioned within the cavity;

the lip being positioned along the lateral surface and being positioned adjacent to the top end;

the first sealing ring and the second sealing ring being positioned along the lateral surface opposite to the cavity;

the first sealing ring and the second sealing ring each being positioned as a raised perimeter upon the lateral surface;

the first sealing ring and the second sealing ring being positioned adjacent to each other;

the first sealing ring and the second sealing ring being positioned adjacent to the bottom surface;

the first sealing ring being located in between the second sealing ring and the bottom surface;

the sealing plug corresponding to each of the plurality of travel containers;

the sealing plug being configured to be selectively and removably stacked on one of the plurality of travel containers; and the sealing plug being removably positioned within the opening of the one of the plurality of travel containers in response to the sealing plug being stacked on the one of the plurality of travel containers.

2. The leak-proof, interlocking, stackable travel container assembly as claimed in claim 1 wherein:

each of the plurality of travel containers comprising a rim, the rim being connected to the neck portion opposite the body portion, the opening being delineated by the rim; and the lip resting on the rim of the one of the plurality of travel containers in response to the sealing plug being removably positioned within the opening of the one of the plurality of travel containers.

3. The leak-proof, interlocking, stackable travel container assembly as claimed in claim 1 comprising:

a protective cap;

the protective cap comprising an inner lateral surface and a cap interlocking mechanism;

the protective cap being removably attached to the one of the plurality of travel containers in response to the sealing plug being stacked on the one of the plurality of travel containers;

the cap interlocking mechanism being removably attached to the neck interlocking mechanism of the one of the plurality of travel containers in response to the protective cap being removably attached to the one of the plurality of travel containers; and the sealing plug being surrounded by the protective cap.

4. The leak-proof, interlocking, stackable travel container assembly as claimed in claim 3 wherein:

the cap interlocking mechanism comprising a plurality of female receptors;

the plurality of female receptors being radially distributed about the inner lateral surface;

the neck interlocking mechanism of each of the plurality of travel containers comprising a plurality of radial pins;

the plurality of radial pins of the one of the plurality of travel containers being removably positioned into the plurality of female receptors; and the sealing plug being secured in between the one of the plurality of travel containers and the protective cap in response to the plurality of radial pins of the one of the plurality of travel containers being positioned into the plurality of female receptors.

5. The leak proof, interlocking, stackable travel container assembly as claimed in claim 3 wherein:

the protective cap comprising an outer lateral surface and a plurality of gripping portions; and the plurality of gripping portions being distributed along the outer lateral surface.

6. The leak proof, interlocking, stackable travel container assembly as claimed in claim 1 wherein:

the neck interlocking mechanism comprising a plurality of radial pins;

the base interlocking mechanism comprising a plurality of female receptors;

the plurality of radial pins being radially distributed about the neck portion in between the opening and the body portion;

the plurality of female receptors being radially distributed about the base portion; and the plurality of radial pins corresponding to the plurality of female receptors.

7. The leak-proof, interlocking, stackable travel container assembly as claimed in claim 1 wherein:

the plurality of travel containers being stacked on each other by the base interlocking mechanism of one of two adjacent travel containers among the plurality of travel containers being attached to the neck interlocking mechanism of the other one of the two adjacent travel containers among the plurality of travel containers; and the sealing plug being secured in between the two adjacent travel containers in response to the base interlocking mechanism of the one of the two adjacent travel containers being attached to the neck interlocking mechanism of the other one of the two adjacent travel containers.

8. The leak-proof, interlocking, stackable travel container assembly as claimed in claim 1 wherein:

the plurality of travel containers comprising a plurality of multi-sized sub-containers.

9. The leak-proof, interlocking, stackable travel container assembly as claimed in claim 1 wherein:

the plurality of travel containers comprising a plurality of one-sized sub-containers.

* * * * *